United States Patent [19]

Cecchi

[11] 4,439,649

[45] Mar. 27, 1984

[54] JOY STICK SWITCH

[75] Inventor: Marino Cecchi, Itasca, Ill.

[73] Assignee: Suncom, Incorporated, Northbrook, Ill.

[21] Appl. No.: 413,000

[22] Filed: Aug. 30, 1982

[51] Int. Cl.[3] ..... H01H 25/04

[52] U.S. Cl. ..... 200/6 A; 200/5 R

[58] Field of Search ..... 200/1 R, 5 A, 6 A, 17 R, 200/18, 153 K, 5 R

[56] References Cited

U.S. PATENT DOCUMENTS

| | | | |
|---|---|---|---|
| 1,735,403 | 11/1929 | MacCarthy | 200/6 A |
| 1,893,371 | 1/1933 | Knowlton | 200/6 A |
| 1,908,430 | 5/1933 | Lapsley | 200/6 A |
| 2,849,548 | 8/1958 | Young | 200/6 A |
| 3,705,276 | 12/1972 | Seeger, Jr. et al. | 200/16 A X |
| 4,181,827 | 1/1980 | Diepeveen | 200/6 A |
| 4,218,702 | 8/1980 | Brocard et al. | 358/109 |
| 4,348,556 | 9/1982 | Gettig et al. | 200/6 A X |
| 4,364,047 | 12/1982 | Archer | 200/6 A X |
| 4,394,548 | 7/1983 | Dola | 200/6 A |

FOREIGN PATENT DOCUMENTS

| | | | |
|---|---|---|---|
| 1008385 | 5/1957 | Fed. Rep. of Germany | 200/6 A |

*Primary Examiner*—J. R. Scott

*Attorney, Agent, or Firm*—Gary, Juettner & Pyle

[57] ABSTRACT

A joy stick assembly is characterized by a joy stick resiliently mounted in an aperture through a hand holdable housing and normally biased to a neutral position. The joy stick is manually pivotable at one of its ends in any one of a plurality of directions through a 360° arc, and has a conductive sphere at its opposite end. Four contacts are positioned at 90° increments around the sphere and out of contact therewith when the sphere is in its neutral position, and the joy stick is manipulatable to establish electrical connections between the sphere and individual ones or adjacent pairs of the contacts to provide a signal from the sphere to the contact or contacts. With separate electrical connections established between the sphere and the four contacts and a tv video game, the joy stick is manipulatable to apply nine discrete signals to the game, four upon electrical connections between the sphere and individual ones of the contacts, another four upon electrical connections between the sphere and adjacent pairs of contacts and a further one when the sphere is in its neutral position.

17 Claims, 6 Drawing Figures

20
26
28
30
2.
22
24
2.

40
26
38
30
44
42
28
22
80
82
49
36
52
46
32
60
4.
4.
34
3.
3.
56
24
50
48

JOY STICK SWITCH

BACKGROUND OF THE INVENTION

The present invention relates to improvements in electrical control devices for operating such things as tv video games and X-Y translating mechanisms, and in particularly to an improved joy stick assembly.

Joy stick assemblies for use with tv video grames for controlling X-Y translations of an image on a tv screen are known in the art. Conventionally, such an assembly comprises a hand holdable box-like housing and a control lever or joy stick extending through a wal of the housing. Switches or contacts within the housing are electrically connected with an input to the video game, and are arranged to be actuated or contacted by the joy stick in response to manual manipulation of the same, thereby to control bidirectional horizontal and/or vertical movement of an image on the screen.

A disadvantage of such joy stick assemblies is that, in an attempt to fabricate them in an economical manner so that the selling price of video games will be within reach of the average purchaser, the resulting assembly is often quite flimsy and prone to breakage, particularly in the hands of a child. In addition, such assemblies are often quite spongy in their operation, with the result that an operator does not have a "feel" for the game being played, while at the same time movement of the image on the tv screen in response to manipulation of the joy stick is inaccurate and slow.

In addition to use with tv video games, joy stick assemblies also find use in industrial manufacturing operations, such for example as with thermal compression of ultrasonic bonders which use an X-Y translating mechanism having a platform which supports a semiconductor chip and moves the same relative to and below a bonding tool of the bonder, so that electrical lead wires can be connected to the chip at various locations thereon. Such a translating mechanism is operated by two motors, one for driving the platform back and forth along one line and another for moving the platform back and forth along a second line perpendicular to the first.

The control means for operating the motors of such bonders often comprises a joy stick assembly manipulated by a machine operator as he views the work area of the chip through a microscope. Conventional joy stick assemblies for this purpose have been quite complicated in construction, and have used potentiometers or other switching devices for varying the voltages applied to the motors, so that the motors stop and go as a function of the change in position of the joy stick. Because of the complex nature of such assemblies, they are costly to produce and assemble and must often be repaired or replaced due to faults in the parts thereof.

OBJECT OF THE INVENTION

The primary object of the invention is to provide an improved joy stick assembly which is simple and rugged in construction, is inexpensive to produce and maintain, provides a very accurate "feel" to an operator and can be used as a replacement part for a conventional joy stick device.

SUMMARY OF THE INVENTION

In accordance with the present invention, a joy stick assembly comprises a housing having an opening therethrough and a joy stick extending through said opening.

Said joy stick has a resilient member therearound for pivotally mounting said joy stick on the housing for movement in any direction throughout a 360° arc from an equilibrium position to an operative position and return, and an electrically conductive member is at one end of the joy stick. In addition, a plurality of electrically conductive contact elements are on said housing in an array in surrounding relationship to said conductive member. Said conductive member is out of engagement with said contact elements when said joy stick is in said equilibrium position, and each said contact is engageable by said conductive member as a function of pivotal movement of said joy stick away from said equilibrium position in a predetermined direction, thereby to selectively establish electrical connections between said conductive member and said contacts.

Other objects, advantages and features of the invention will become apparent upon a consideration of the following detailed description, when taken in conjunction with the accompanying drawings.

DETAILED DESCRIPTION

Figure 1:
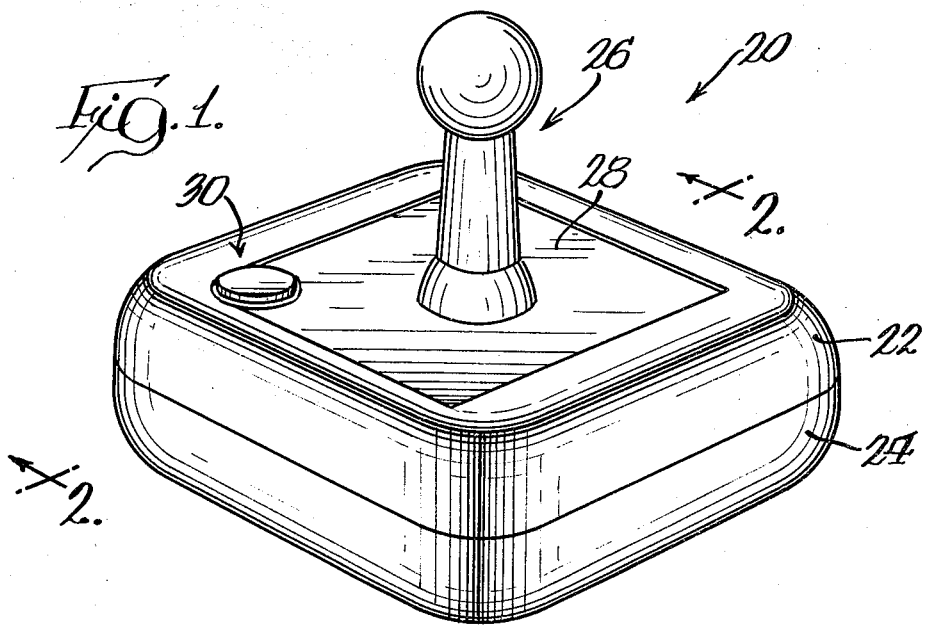
FIG. 1 is a perspective view of a joy stick assembly of a type with which the teachings of the present invention may advantageously be used.

Referring to FIG. 1, a joy stick assembly is indicated generally at 20 and comprises a hand holdable box-like casing formed by an upper housing portion 22 and a lower housing portion 24. A joy stick or control lever, indicated generally at 26, is pivotally carried in an upper wall 28 of the upper housing and a pushbutton type start switch, indicated generally at 30, is also carried by the housing and extends through the wall. The joy stick assembly is particularly adapted for electrical connection and use with a tv video game (not shown), or other types of X-Y translating mechanisms, and to that end the start switch is actuable to start a game while the joy stick is manually manipulatable for selective control over movement of an image on a tv screen (not shown). As is conventional and understood in the art, the joy stick is movable forward, backward, left and right to control respective vertical up and down and horizontal left and right movement of the image on the screen, and is also movable toward the four corners of the case for simultaneous up or down and left or right movement of the image.

Figure 2:
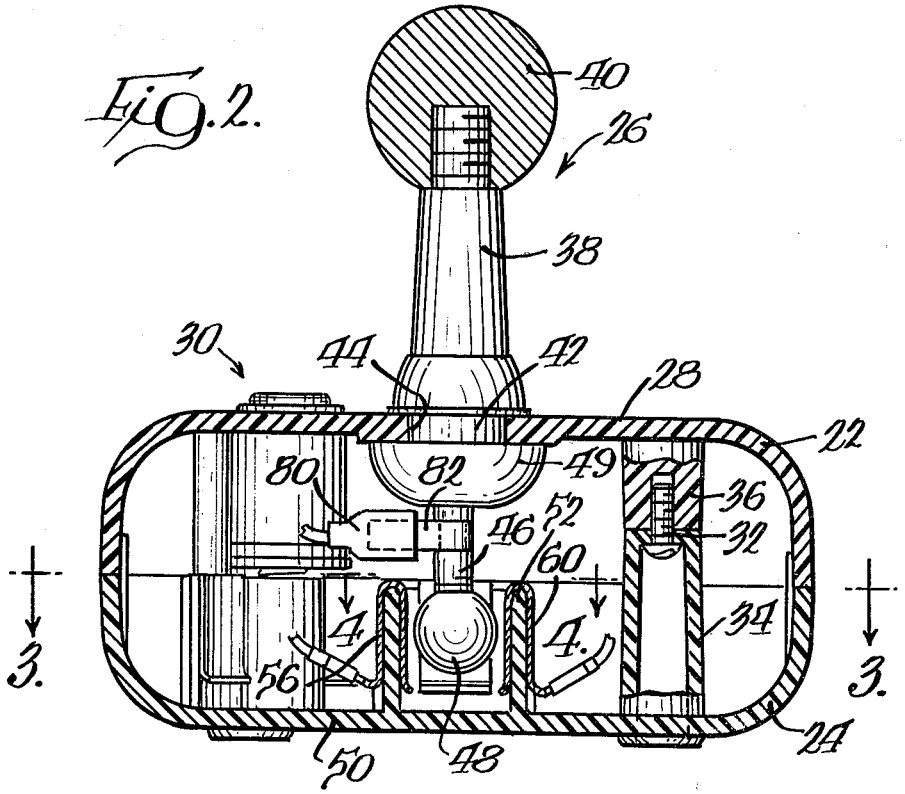
FIG. 2 is a cross sectional side elevation view taken substantially along the lines 2—2 of FIG. 1, showing the manner in which a joy stick or control lever is mounted on a housing of the assembly for manipulation in directions to selectively engage a lower conductive end thereof with contacts within the housing.
Figure 3:
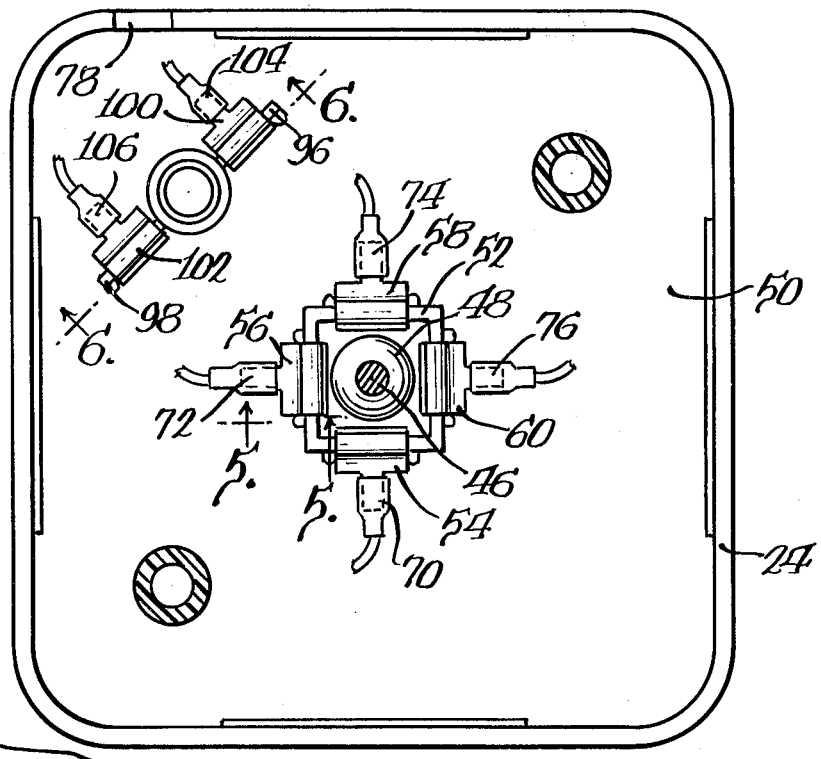
FIG. 3 is a top plan view taken substantially along the lines 3—3 of FIG. 2, and illustrates the arrangement of contacts within the housing and the positioning of the lower conductive end of the joy stick with respect to four of the contacts.
Figure 5:
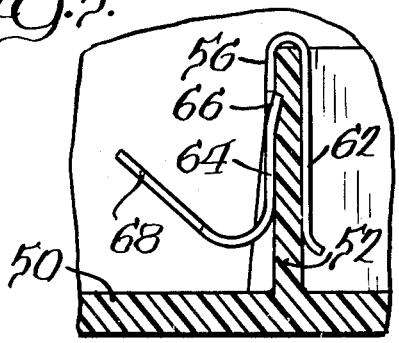
FIG. 5 is a cross sectional side elevation view taken substantially along the lines 5—5 of FIG. 3, and illustrates the configuration of one of the contacts and its mounting on the housing.

Referring also to FIGS. 2, 3 and 5, when assembled, the upper and lower housing portions 22 and 24 are fastened together by means of screws 32 extended through upstanding hollow columns 34 on the lower housing and threaded into protuberances 36 depending from the upper housing. In the preferred embodiment, the joy stick 26 comprises a metallic or otherwise rigid insert sheathed in a resilient material, such for example as a conventional tire valve stem 38 which has threaded onto or otherwise secured to its upper end a spherical knob 40 and is received by means of a groove 42 in a resilient rubber casing or sheath thereof in a passage 44 in the wall 28. The valve stem is modified to carry a downwardly extending conductive rod 46 at its lower end, and a conductive sphere 48 is at the bottom of the rod. Because the outer surface or casing of the valve stem is formed of resilient rubber, and in particular an enlarged generally bulbous lower end 49 thereof, upon being placed in the housing passage 44 it is automatically pivotally mounted therein and on the housing 22, so that by means of manual manipulation of the spherical knob 40 the joy stick may be pivoted in any one of a plurality of directions through a 360° arc. When the knob is released, the resilience of the rubber returns the joy stick to a neutral upright position.

Extending upwardly from a base wall 50 of the lower housing 24 and positioned about the conductive sphere 48 is an open ended generally square enclosure 52 having four walls on which are mounted respective conductive contacts 54, 56, 58 and 60. As best shown in FIG. 5, each contact is in the form of a clip received over a respective one of the walls of the enclosure 52, and includes a surface 62 to the interior of the enclosure, a surface 64 to the exterior of the enclosure and having a tab 66 for being received within a recess in the wall to secure the contact thereon, and a male connector 68 extending outwardly from a lower end of the surface 64. Female connectors 70, 72, 74 and 76 are coupled with the male connectors of the respective contacts 54, 56, 58 and 60, and individual wires connected with the female connectors extend outwardly of the casing through a passage 78 in the lower housing 24 for connection with the tv video game. A female connector 80 is coupled with a male connector 82 on the conductive rod 46 of the joy stick 26, and a wire also extends from that connector through the passage for connection with the game.

Figure 4:
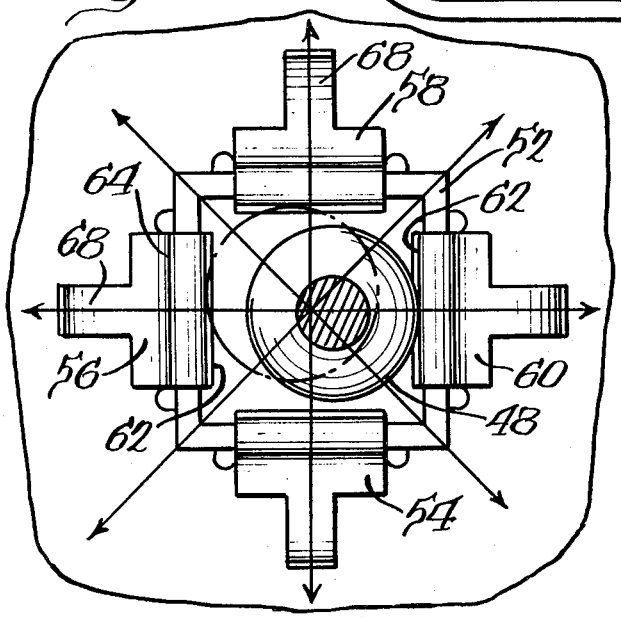
FIG. 4 is a top plan view taken substantially along the lines 4—4 of FIG. 2, and shows the directions of movement of the lower end of the joy stick for contacting individual ones or adjacent pairs of the four contacts.

As shown in FIGS. 2 and 3, when the joy stick 26 is not manually manipulated and is automatically being maintained in its neutral or upright position by the resilience of the tire valve stem 38, the conductive sphere 48 is positioned between and out of electrical contact with the surfaces 62 of the contacts 54, 56, 58 and 60. The spacing between facing edges of the surfaces 62 of adjacent contacts is less than the diameter of the sphere, and in normal use of the joy stick assembly ground potential or a reference voltage is coupled from the video game to the sphere through the connectors 80 and 82, such that upon movement of the sphere into electrical engagement with one or a pair of the contacts, ground or reference potential is coupled through the contact or contacts and their associated connectors and wires with the game to control movement of an image on the tv screen. Thus, and as shown in FIG. 4, by selective manual manipulation of the spherical knob 40 the conductive sphere 48 may be moved forward, backward or sideways into electrical contact with any one of the surfaces 62 of the contacts 54, 56, 58 and 60, thereby to provide four discrete electrical signals to the game. The sphere may also be moved toward a selected corner of the casing and into simultaneous engagement with a selected adjacent pair of the contacts, thereby providing four additional discrete electrical signals to the game. In addition, when the joy stick is in its neutral position and the sphere is not electrically connected with any of the contacts, a further electrically distinct signal is generated and applied to the game, i.e., the absence of ground or reference on any of the contacts. Consequently, nine discrete electrical signals may be generated for application to the game, such that the eight signals generated by contact of the sphere with the contacts provide for bidirectional horizontal and/or vertical movement of an image on the tv screen, with the signal generated in response to the sphere being in its neutral position and out of engagement with any of the contacts causing the image to remain stationary or otherwise move in a preprogrammed fashion. The particular structure of the joy stick enables very accurate and rapid control over the game.

Figure 6:
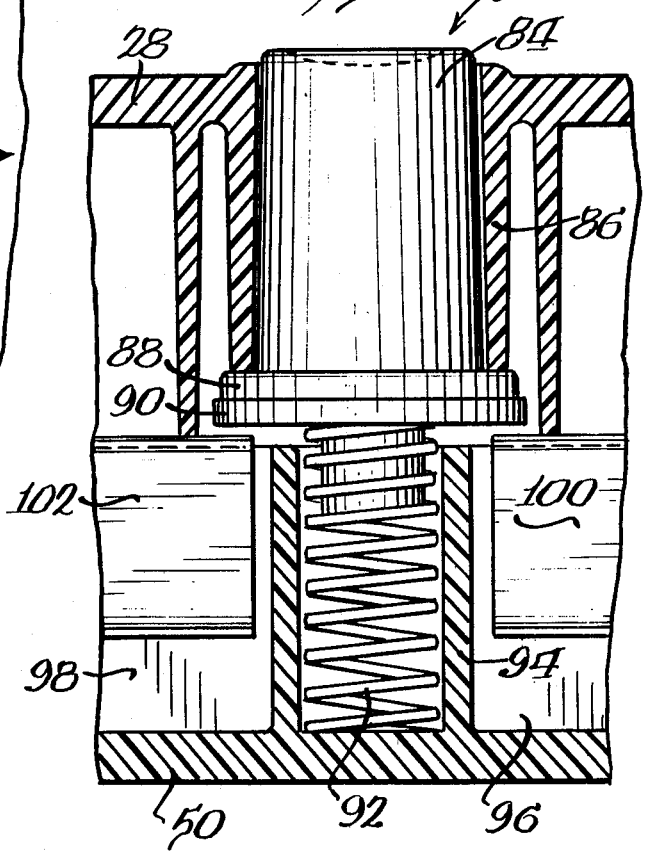
FIG. 6 is a cross sectional side elevation view taken substantially along the lines 6—6 of FIG. 3, and shows a switch for initiating an operation, control over which is then exercised by means of manipulation of the joy stick.

As is also known, joy stick assemblies commonly include some means for controlling initiation of an operation, such as initiation of a game or firing of a cursor in the case of use with a tv video game, and to that end the start switch 30 is provided. As shown in FIGS. 3 and 6, the start switch includes an actuator button 84 slidably received within a tubular extension 86 extending downwardly from the upper wall 28 of the housing 22. The button has a lower radial flange 88 and a conductive lower surface 90, and is normally urged upwardly by a spring 92 captured within a tubular extension 94 of the base wall 50 to move the flange against a lower edge of the tubular extension 86.

Positioned on respective walls 96 and 98 upstanding from the base wall 50 are a pair of contacts 100 and 102, which preferably are identical to the contacts 54, 56, 58 and 60. The contacts 100 and 102 are positioned to underlie opposite sides of the conductive lower surface 90 of the actuator button 84, and are coupled through respective female connectors 104 and 106 and associates wires with the video game, the wires also passing through the lower housing passage 78. One of the contacts would normally be coupled with ground or reference potential from the game, whereby upon depression of the actuator button and movement of the conductive lower surface of the button against the contacts the potential is connected with the other contact to provide a signal to start the game.

The invention thus provides an improved joy stick assembly for tv video games or other operations either industrial or otherwise where control over X-Y coordinate movement is required. Because the resilience of the joy stick is provided by the resilient sheath on its outer surface, which in the preferred embodiment is the rubber sheath on a conventional tire valve stem, and by virtue of a conductive sphere being moved directly into engagement with a contact upon manipulation of the joy stick, thereby to generate signals without need to actuate mechanical switches, a user has a very definite or precise "feel" when manipulating the joy stick, which results in highly accurate and fast control. At the same time, since the casing of the assembly may be molded in plastic, the joy stick itself may be a conventional tire valve stem and the electrical contacts may be simple clips, the cost of the assembly in drastically reduced while at the same time it has significantly improved reliability and durability as compared with prior devices.

While one embodiment of the invention has been described in detail, various modifications and other embodiments thereof may be devised by one skilled in the art without departing from the spirit and scope of the invention, as defined in the appended claims.

What is claimed is:

1. A joy stick assembly, comprising a housing having top, bottom and side walls and an opening through said top wall; a joy stick extending through said opening, said joy stick having a resilient member around a medial portion thereof secured to said top wall in said opening and pivotally mounting said joy stick therein and on said housing in said opening for pivotal movement within said opening in any direction throughout a 360° arc from an equilibrium position to an operative position and return and a member of electrically conductive material at a lowermost end thereof; and a plurality of contact elements of electrically conductive material on said housing bottom wall in an array in surrounding relationship to said conductive member, said conductive member being out of engagement with said contacts when said joy stick is in said equilibrium position and each said contact being engageable by said conductive member upon movement of said conductive member through an arcuate path as a function of pivotal movement of said joy stick away from said equilibrium position in a predetermined direction to electrically connect said conductive member and said contacts.

2. A joy stick assembly as in claim 1, wherein said housing bottom wall has upwardly extending surface extensions for mounting said contacts above said bottom wall in said array around said conductive member.

3. A joy stick assembly as in claim 1, wherein said plurality of contacts comprises an array of four contacts positioned 90° apart in surrounding relationship to said conductive member with the spacings between adjacent pairs of contacts being such that said joy stick is pivotable from said equilibrium position both to engage and electrically connect said conductive member with selected individual ones of said contacts and to simultaneously engage and electrically connect said conductive member with selected adjacent pairs of said contacts to electrically connect said selected adjacent pairs of contacts and said conductive member.

4. A joy stick assembly as in claim 1, wherein said joy stick comprises a tire valve stem having a resilient outer casing with an annular groove therein receiving said housing top wall around said opening to pivotally mount said joy stick on said housing, a manually manipulatable knob at an upper end of said tire valve stem for accommodating manual pivotal movement of said joy stick and a rod connected at its upper end to a lower end of said tire valve stem and mounting said conductive member at its lowermost end.

5. A joy stick assembly as in claim 1, wherein said conductive member comprises an electrically conductive sphere.

6. A joy stick assembly as in claim 1, including means for establishing separate electrical connections with each of said contacts and said conductive member.

7. A joy stick assembly as in claim 1, including switch means on said housing having a pair of switch contacts, said switch means being separate and distinct from said conductive member and said contact elements and being manually actuable to establish an electrical connection between said switch contacts.

8. A joy stick assembly as in claim 7, said housing top wall having a second opening therethrough and said switch means comprising a manually manipulatable actuator slidably received through said second opening, an electrically conductive surface on one end of said actuator, said pair of switch contacts being supported on said housing bottom wall in alignment with said conductive surface for contact therewith upon sliding movement of said actuator toward said switch contacts, and means for yieldably urging said actuator to an upper position to normally maintain a spacing between said switch contacts and said conductive surface, said actuator being manually movable downwardly against said urging means to bring said conductive surface into engagement with said switch contacts to establish said electrical connection therebetween.

9. A joy stick assembly as in claim 8, wherein said housing bottom wall has surface extensions for mounting said pair of switch contacts.

10. A joy stick assembly as in claim 1, wherein said housing comprises first and second housing portions connectable to define a chamber therebetween, said first housing portion having said top wall with said opening therein for pivotally mounting said joy stick with a lower end of said joy stick and said conductive member extending to the interior of said chamber, said second housing portion having said bottom wall and said contacts being mounted on said bottom wall in said array around said conductive member and to the interior of said chamber.

11. A joy stick assembly as in claim 1, including a plurality of electrical conductors, and means for connecting individual ones of said electrical conductors with respective ones of said contacts and with said conductive member, said housing having a second opening therethrough and said conductors extending through said second opening to the exterior of said housing.

12. A joy stick assembly, comprising a housing having an opening therethrough, a joy stick extending through said opening, said joy stick having a resilient member therearound pivotally mounting said joy stick on said housing in said opening for movement in any direction throughout a 360° arc from an equilibrium position to an operative position and return and a member of electrically conductive material at one end thereof; and a plurality of contact elements of electrically conductive material on said housing in an array in surrounding relationship to said conductive member, said conductive member being out of engagement with said contacts when said joy stick is in said equilibrium position and each said contact being engageable by said conductive member as a function of pivotal movement of said joy stick away from said equilibrium position in a predetermined direction to electrically connect said conductive member and said contacts, wherein said conductive member comprises a rod of electrically conductive material fastened at one end to said one end of said joy stick and a sphere of electrically conductive material carried on and electrically connected with an opposite end of said rod, said contacts being in an array in surrounding relationship to said sphere.

13. A joy stick assembly, comprising a housing having an opening therethrough; a joy stick extending through said opening, said joy stick having a resilient member therearound pivotally mounting said joy stick on said housing in said opening for movement in any direction throughout an 360° arc from an equilibrium position to an operative position and return and a member of electrically conductive material at one end thereof; and a plurality of contact elements of electrically conductive material on said housing in an array in surrounding relationship to said conductive member, said conductive member being out of engagement with said contacts when said joy stick is in said equilibrium position and each said contact being engageable by said conductive member as a function of pivotal movement of said joy stick away from said equilibrium position in a predetermined direction to electrically connect said conductive member and said contacts, wherein said housing has an open ended generally square extension defining four walls positioned 90° apart, said plurality of contacts comprise four contacts each mounted on a respective one of said walls and having a portion extending across the wall to the interior of said square extension, and said conductive member extends into said square extension through said open end thereof in spaced relationship from said portions of said contacts when said joy stick is in said equilibrium position, said joy stick being pivotable in predetermined directions from said equilibrium position to engage and electrically connect said conductive member with said portion of selected ones of said contacts.

14. A joy stick assembly as in claim 13, wherein the spacing between said portions of adjacent pairs of contacts is such that said joy stick is also pivotable in predetermined directions away from said equilibrium position to simultaneously engage and electrically connect said conductive member with selected adjacent pairs of contacts.

15. A joy stick assembly as in claim 13, wherein said contacts comprise generally U-shaped electrically conductive clips over ends of said walls at said open end of said generally square extension.

16. A joy stick assembly as in claim 15, wherein said contacts grip opposite sides of said walls, said conductive member comprises an electrically conductive sphere, and said portions of said contacts to interior of said generally square extension have a lateral extent across said walls which is insufficient to engage and establish an electrical connection between adjacent pairs of said contacts but sufficient to enable said sphere to simultaneously engage and electrically contact selected adjacent pairs of said contacts upon pivotal movement of said joy stick in predetermined directions away from said equilibrium position.

17. A joy stick assembly as in claim 15, wherein outer portions of said contacts to exterior of said extension are formed with tabs and outer surfaces of said walls have recesses for receiving said tabs to secure said contacts thereon.

* * * * *